US009702229B2

(12) United States Patent
Zhou

(10) Patent No.: US 9,702,229 B2
(45) Date of Patent: Jul. 11, 2017

(54) EXPANDABLE LINER HANGER AND METHOD OF USE

(71) Applicant: Saudi Arabian Oil Company, Dhahran (SA)

(72) Inventor: Shaohua Zhou, Dhahran Hills (SA)

(73) Assignee: SAUDI ARABIAN OIL COMPANY (SA)

( * ) Notice: Subject to any disclaimer, the term of this patent is extended or adjusted under 35 U.S.C. 154(b) by 650 days.

(21) Appl. No.: 13/966,868

(22) Filed: Aug. 14, 2013

(65) Prior Publication Data

US 2014/0054047 A1 Feb. 27, 2014

Related U.S. Application Data

(60) Provisional application No. 61/693,656, filed on Aug. 27, 2012.

(51) Int. Cl.

| | |
|---|---|
| ***E21B 43/10*** | (2006.01) |
| ***E21B 23/04*** | (2006.01) |
| ***E21B 23/06*** | (2006.01) |

(52) U.S. Cl.

CPC ..... *E21B 43/106* (2013.01); *E21B 23/04* (2013.01); *E21B 23/06* (2013.01); *E21B 43/103* (2013.01); *E21B 43/105* (2013.01)

(58) Field of Classification Search

CPC ..... E21B 43/103; E21B 43/105; E21B 43/106
See application file for complete search history.

(56) References Cited

U.S. PATENT DOCUMENTS

| | | | | |
|---|---|---|---|---|
| 6,997,266 | B2 | 2/2006 | Jackson | |
| 7,779,909 | B2 | 8/2010 | Noel | |
| 2003/0168222 | A1* | 9/2003 | Maguire | E21B 43/105 166/380 |
| 2004/0216894 | A1* | 11/2004 | Maguire | E21B 43/103 166/384 |

(Continued)

OTHER PUBLICATIONS

PCT Communication Relating to the Results of the Partial International Searching Authority; dated Nov. 12, 2014; International Application No. PCT/US2013/056749; International File Date: Aug. 27, 2013.

(Continued)

*Primary Examiner* — Robert E Fuller
(74) *Attorney, Agent, or Firm* — Bracewell LLP; Constance Gall Rhebergen

(57) ABSTRACT

An expandable liner hanger system for forging a pressure seal and hanging of the liner weight against outer casing string in a wellbore that includes an outer casing string, and an inner casing string positioned within the outer casing string and having an inner diameter. The system also includes an elongate inner string tool selectively insertable into the inner casing string and having a torque locking sleeve that removably couples with the inner casing string. Also included in the expandable liner hanger system is an expansion cone slidable along the inner string tool and having a diameter greater than the inner diameter of the inner casing string so that when the cone is urged into the inner casing string, the larger diameter cone deforms the inner casing string radially outward into engagement with the outer casing string. The system also includes a downhole hydraulic force intensifier.

10 Claims, 12 Drawing Sheets

(56) References Cited

U.S. PATENT DOCUMENTS

| | | | | |
|---|---|---|---|---|
| 2006/0124295 | A1 | 6/2006 | Maguire | |
| 2008/0083541 | A1* | 4/2008 | Butterfield | E21B 43/105 166/386 |
| 2008/0277111 | A1* | 11/2008 | Braddick | E21B 43/105 166/206 |
| 2010/0147535 | A1 | 6/2010 | Gorrara et al. | |
| 2011/0132623 | A1 | 6/2011 | Moeller | |
| 2011/0168408 | A1 | 7/2011 | Watson | |
| 2012/0097391 | A1* | 4/2012 | Whiddon | E21B 29/10 166/277 |
| 2012/0186829 | A1 | 7/2012 | Watson | |
| 2012/0222868 | A1 | 9/2012 | Hazelip | |

OTHER PUBLICATIONS

PCT Communication Relating to the Results of the Partial International Searching Authority; dated Aug. 28, 2014; International Application No. PCT/US2013/056749; International File Date: Aug. 27, 2013.

* cited by examiner

EXPANDABLE LINER HANGER AND METHOD OF USE

BACKGROUND OF THE INVENTION

1. Field of the Invention

The present invention relates to drilling oil and gas wells. In particular, the present invention relates to liner hanger systems for use in providing cemented zonal isolation via lining casing strings in oil and gas wells.

2. Description of the Related Art

Oil wells typically have casing strings, or liners, installed prior to penetrating a reservoir and beginning production of oil and gas. Such casing strings provide weight hanging capability and pressure zonal isolation. In some instances, it may be necessary to run more than one casing string. In such instances, the first casing string, installed at the top of the well, has the largest diameter. Thereafter, a subsequent casing string is placed into the well by passing it through the already installed first casing string.

As the subsequent section of casing string is positioned in the well, and in particular at the top of a reservoir, it is typically sealed and locked to the already installed casing string via a liner hanger assembly. In addition, cement is typically pumped down the well, through the drillpipe and liner string, and then back up the well on the outside of the liner string. Proper hanging and cementing of liner string is important to isolate the production path within the liner string. Failure to install the liner string properly can lead to costly lost rig time, additional well repair cost, and wellbore pressure integrity problems later on. Although many conventional liner hanger assemblies have been developed, there are still repeated failures reported in the industry, such as, for example, leaks across the liner top packer, and problems with naming and setting tools.

One element for the installation of liner is the expandable liner hanger. In an expandable liner hanger, an inner casing string is run into position in the wellbore through a previously installed outer casing string. Once in place, an upper end of the inner casing string is expanded into contact with the inside walls of the outer casing string at a depth typically a couple of hundred feet above its shoe. The inner casing string diameter can be expanded by forcing an expansion cone into the top of the outer casing string.

Because the expansion cone is commonly located at the bottom of the polished bore receptacle (PBR) or tie-back receptacle (TBR), which is located immediately above the expandable casing string and sealing elements, the area for cement slurry flow is restricted. In wells having high formation pressure, which require high mud weight and high density cement slurry, there is an increased risk of incurring losses of cement slurry during liner cementing operations. This is, to a large extent, because of the high equivalent circulating density due to rather narrow clearances between the outer-diameter of the expansion cone and setting tools housing, and the outer casing. Consequently, voids or poor cement bond between the outer casing and liner and/or between the liner and rock formation may develop, which could lead to possible leak paths, or poor zonal isolation.

SUMMARY OF THE INVENTION

One embodiment of the present invention provides an expandable liner hanger/system for forging a pressure seal and hanging of the liner weight against the outer casing string in a wellbore. The expandable liner hanger system includes an outer casing string, and an inner casing string positioned within the outer casing string and having an inner diameter. In addition, the expandable liner hanger system includes an elongate inner string tool selectively insertable into the inner casing string and having a torque locking sleeve that removably couples with the inner casing string. Also included is an expansion cone slidable along the inner string tool and having a diameter greater than the inner diameter of the inner casing string so that when the cone is urged into the inner casing string, the larger diameter cone deforms the inner casing string radially outward into engagement with the outer casing string.

In some embodiments, the inner casing string can have locking ridges on an outer surface thereof, the locking ridges arranged so that when the portion of the inner casing string expands into engagement with the outer casing string, the locking ridges fixedly engage the outer casing string. In addition, a seal can be provided surrounding the inner casing string and arranged to seal the interface between the inner and outer casing strings when the portion of the inner casing string is expanded into engagement with the outer casing string.

The expandable liner hanger system can also include a slide bar having a first end and a second end, wherein the slide bar is attached to the inner string tool and is axially slideable relative thereto. The slide bar can be arranged so that its upper end contacts the expansion cone when the expansion cone is inserted into the inner casing string, and so that upon contact with the expansion cone, the lower end contacts the torque locking sleeve and pushes the torque locking sleeve out of engagement with the inner string tool.

The expansion cone can have a pressure equalization hole that provides fluid communication between a bottom portion and a top portion of the expansion cone, to equalize pressure between an area below the expansion cone and an area above the expansion cone when the expansion cone is pushed into the inner casing string. In addition, a shear pin can engage the torque locking sleeve and the inner casing hanger to limit axial movement therebetween.

In certain embodiments the expandable liner hanger can also include a hydraulic force intensifier for urging the expansion cone, and that includes a sliding mandrel having first and second ends and surrounding the inner string tool, the sliding mandrel hydraulically driven between a first position and a second position. The hydraulic force intensifier can also include a force head attached to the second end of the sliding mandrel that contacts the expansion cone and pushes it into the inner casing string when the sliding mandrel moves from the first position to the second position. Furthermore, the hydraulic force intensifier can include a gap between at least a portion of the sliding mandrel and the inner string tool, the gap fluidly connected to an inner surface of the inner string tool by a fluid port, and an inner movable sleeve positioned inside the inner string tool and having an aperture, the inner movable sleeve having an open position and a closed position. When in an open position, the aperture is aligned with the fluid port so that there is fluid communication between the gap and the inside of the inner string tool. When in a closed position, the aperture is not aligned with the fluid port so that the gap is isolated from the inside of the inner string tool.

Some embodiments of the invention contemplate an inner string tool of the hydraulic force intensifier having teeth or thread form that engage the inner casing string to prevent axial movement of the inner string tool relative to the inner casing string. This threaded engagement provides the counter balance force during the stroke of the expansion cone against the top portion of the inner casing string (expandable liner hanger). In addition, some embodiments contemplate an expansion cone has tapered upper and lower surfaces with a minimum diameters less than the inner diameter of the inner casing string.

Another embodiment of the present invention provides a downhole hydraulic force intensifier for inserting an expansion tool into a casing string in a wellbore. The downhole hydraulic force intensifier includes an inner string tool having an upper end, a lower end, and an axial bore, and extending into the wellbore, the lower end configured for releasable engagement with a casing string in the wellbore, as well as a sliding mandrel having an up position and a down position, and having mandrel portions, the sliding mandrel surrounding, and axially slideable relative to, the inner string tool. The hydraulic force intensifier further includes an outer housing surrounding the inner string tool and the sliding mandrel, the outer housing and the sliding mandrel configured so that there is a gap between the outer housing and at least part of each mandrel portion, the gap in fluid communication with the inner string tool axial bore via a fluid port. The outer housing and the sliding mandrel are configured so that each mandrel portion is sealingly engaged with the outer housing at points above and below the gap between the outer housing and each mandrel portion. When the sliding mandrel is in its up position, the gap between the outer housing and each mandrel portion is smaller than when the sliding mandrel is in its down position, and the introduction of fluid into each gap while the mandrel is in its up position increases the hydraulic pressure within the gap, thereby forcing the gap to expand and pushing the sliding mandrel into its down position. When the sliding mandrel is in its down position, it contacts the expansion tool and pushes the expansion tool into engagement with the casing string.

The downhole hydraulic force intensifier can also include a ball within the axial bore of the inner string tool, and a ball seat within the axial bore of the inner string tool. The ball seat can be configured to sealingly engage the ball and to limit downward movement of the ball within the axial bore, such that when the ball is engaged with the ball seat, fluid within the axial bore cannot continue travel through the axial bore but is forced through the fluid ports and into the gaps between the outer housing and the mandrel portions.

In addition, a gap can be provided between at least a portion of the sliding mandrel and the inner string tool, the gap fluidly connected to inner surface of the inner string tool by a fluid port. An inner movable sleeve can be positioned inside the inner string tool, and can have an aperture, the inner movable sleeve having an open position and a closed position. When in an open position, the can be aperture aligned with the fluid port so that there is fluid communication between the gap and the inside of the inner string tool. When in a closed position, the aperture can be offset from the fluid port so that the gap is isolated from the inside of the inner string tool. In some embodiments, the ball seat can be attached to the inner movable sleeve, and contact between the ball and the ball seat can cause the inner movable sleeve to move from the closed to the open position.

Yet another embodiment of the present invention provides a method of locking and sealing an inner casing string to an outer casing string in a wellbore. The method includes the steps of (a) inserting an inner casing string into an outer casing string, (b) inserting an expansion cone into the outer casing string above the top end of the inner casing string, and (c) inserting a hydraulic force intensifier into the outer casing string. The method also includes the steps of (d) pushing the expansion cone downward into the top of the inner casing string with the hydraulic force intensifier to expand the top of the inner casing string into engagement with the outer casing string, and (e) removing the hydraulic force intensifier and the expansion cone from the wellbore.

In some embodiments, the method can also include, before step (d) above, the step of inserting cement through the inner casing string to cement the inner casing string to the wellbore. In addition, the method can include after inserting cement through the inner casing string, the step of inserting a wiper dart through the inner string tool to clear away residual cement.

In some embodiments, the method can include, after step (d), the step of inserting cleaning fluid to the outer casing string to remove residual cement from the portion of the outer casing string above the inner casing string. The method can also include the step of pressure testing the interface between the inner and outer casing strings after step (d), and, before step (e), lowering the pressure in the annulus.

BRIEF DESCRIPTION OF THE DRAWINGS

Embodiments of the present invention will be better understood on reading the following detailed description of nonlimiting embodiments thereof, and on examining the accompanying drawings, in which.

DETAILED DESCRIPTION OF THE EXEMPLARY EMBODIMENTS

Figure 1:
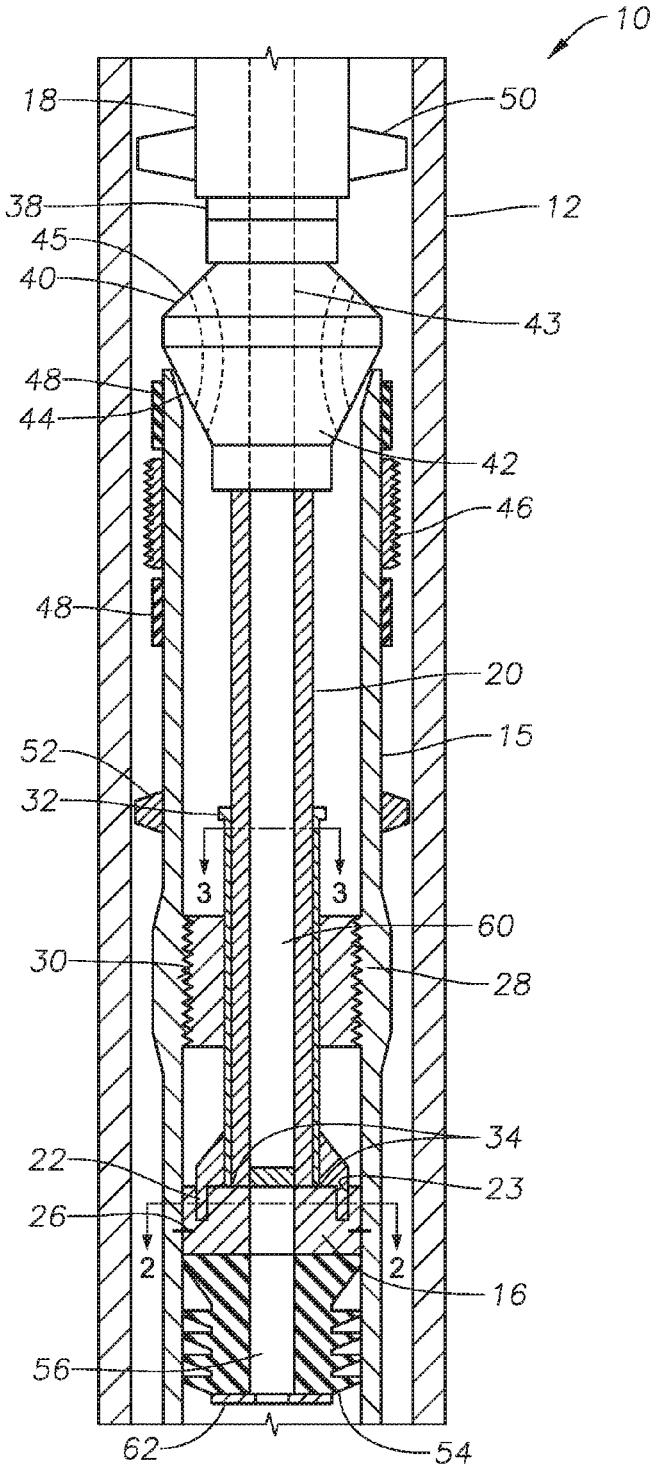
FIG. 1 is a side cross-sectional view of an embodiment of an expandable liner hanger system.

The foregoing aspects, features, and advantages of embodiments of the present invention will be further appreciated when considered with reference to the following description of preferred embodiments and accompanying drawings, wherein like reference numerals represent like elements. In describing the embodiments of the invention illustrated in the appended drawings, specific terminology will be used for the sake of clarity. However the embodiments are not intended to be limited to the specific terms used, and it is to be understood that each specific term includes equivalents that operate in a similar manner to accomplish a similar purpose.

Figure 1A:
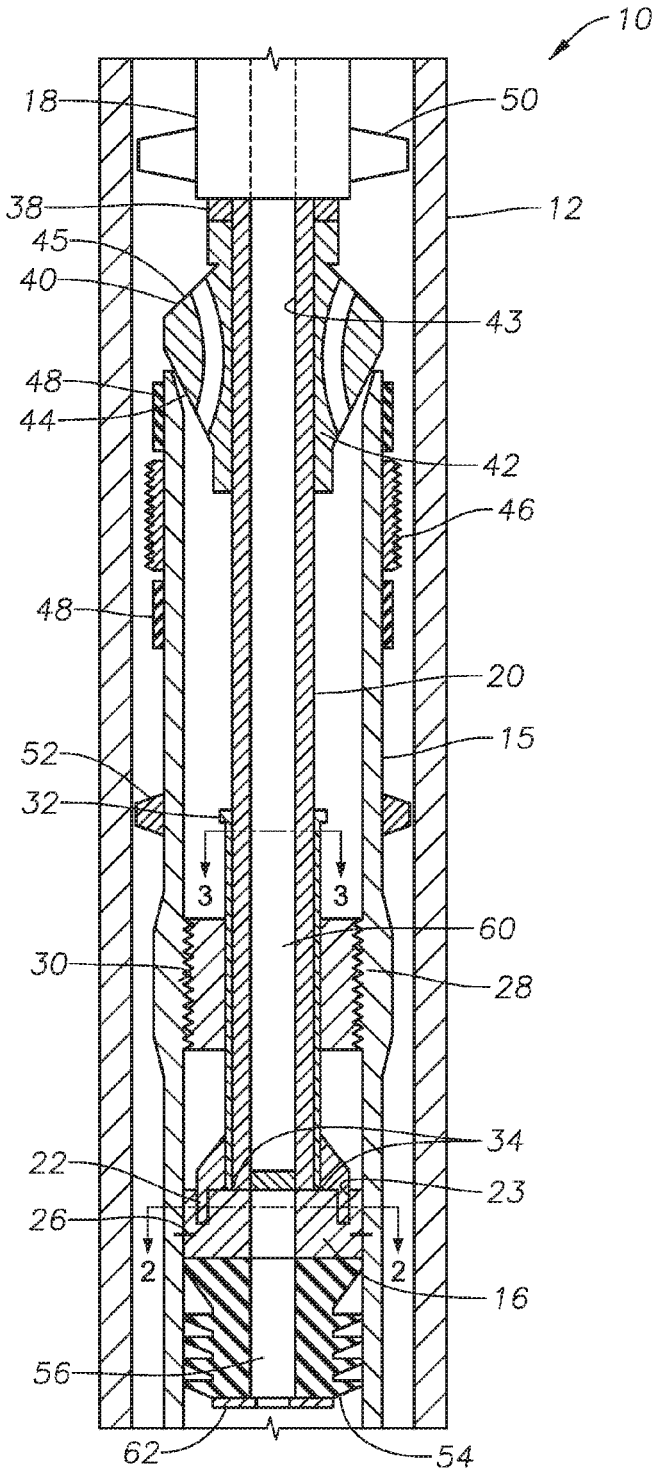
FIG. 1A is a cross-hatched section view of an embodiment of an expandable liner hanger system.
Figure 2:
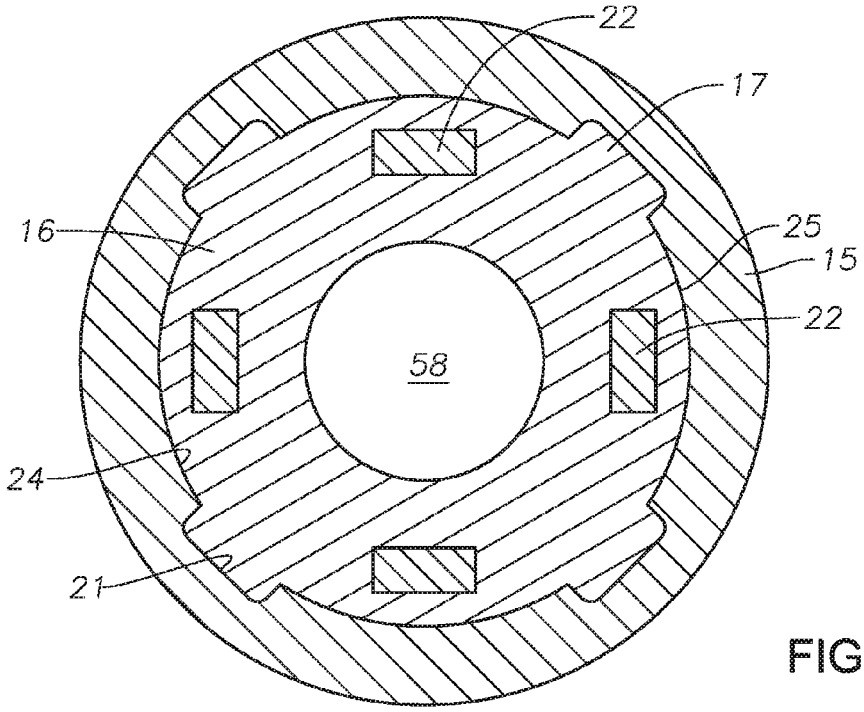
FIG. 2 is a transverse cross-sectional view taken along the line 2-2 of FIG. 1.

FIGS. 1 and 1A show an expandable liner hanger system 10 in accordance with one possible embodiment of the present technology. The expandable liner hanger system 10 is shown inserted in an outer casing string 12, with its lower end projecting into an opening of an inner casing string 15 (or top of the liner). In the example of FIG. 1 and FIG. 1A, the inner casing string 15 is positioned within the outer casing string 12. A torque locking sleeve 16 can be positioned within the inner casing string 15. The torque locking sleeve 16 is constrained from movement within the inner string 15 in an axial and radial direction. For example, as shown in FIG. 2, in some embodiments the torque locking sleeve 16 can have sleeve locking protrusions 17 that extend radially outward from the outer surface 25 of the torque locking sleeve 16, and into engagement with recesses 21 in the inner surface 24 of the inner casing string 15. Referring back to FIG. 1 and FIG. 1A, movement of the torque locking ring 16 relative to the inner casing string 15 can be constrained by sleeve locking pins 26 shown projecting from the casing 15 and radially inward into engagement with the torque locking sleeve 16. Although two pins 26 are shown in FIG. 1 and FIG. 1A, any suitable number of pins may be used.

The expandable liner hanger system 10 can also include a hydraulic force intensifier 18 that has an inner string tool 20. The inner string tool 20 extends longitudinally into the inner casing string 15 and engages the torque locking sleeve 16. The hydraulic force intensifier 18 also includes a sliding mandrel 36 (shown in FIG. 12) having a force head 38. The sliding mandrel 36 and its force head 38 surround, and are configured to axially slide relative to, the inner string tool 20.

In the embodiment of FIG. 1, the inner string tool 20 has sleeve engaging feet 22 that are configured to be received by string tool receiving recesses 23 in the torque locking sleeve 16. When the sleeve engaging feet 22 of the inner string tool 20 are engaged with the torque locking sleeve 16, the inner string tool 20 is rotationally locked to the torque locking sleeve 16. In addition, an outer surface of the inner casing string 15 can have an inner string tool engaging profile 28 configured to engage corresponding teeth 30 on an inner surface of the inner string tool 20. In the embodiments shown, teeth 30 may be male threads, and engaging profile 28 may be corresponding female threads. This engagement constrains axial movement of the inner string tool 20 relative to the inner casing string 15. In the embodiment of FIG. 1, the inner string tool 20 is configured so that when the sleeve engaging feet 22 are engaged with the tool receiving recesses 23, the teeth 30 are also engaged with the inner string tool engaging teeth 28.

Figure 3:
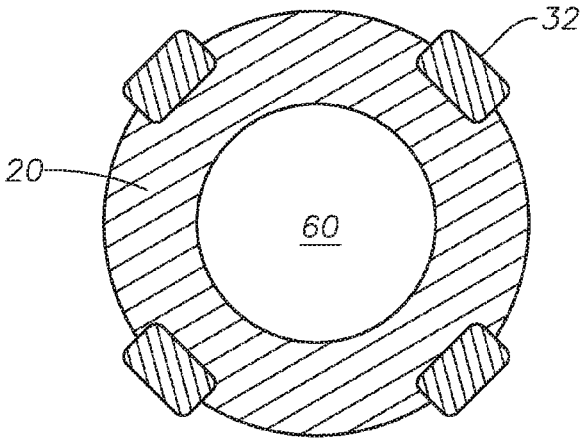
FIG. 3 is a transverse cross-sectional view taken along the line 3-3 of FIG. 1.

Inner string tool 20 can also have bars 32 that are slidably engaged with the inner string tool 20. As shown in FIG. 3, the bars 32 are elongate members that can be partially embedded axially along an outer surface of the inner string tool 20 so that they cannot move about the circumference of the inner string tool 20. The bars 32 are, however, free to move axially relative to the inner string tool 32. As shown in FIG. 1, the bars 32 can be positioned so that the lower ends 34 of the bars 32 contact, or are positioned near, the torque locking sleeve 16.

The expandable liner hanger system 10 of FIG. 1 also includes a frusto-conical expansion cone 40. The expansion cone 40 shown has a tapered bottom section 42 having lower sidewalls 44 that radially expand from a diameter smaller than the inside diameter of the inner casing string 15 at a lower end, to a diameter larger that the inside diameter of the inner casing string 15 at an upper end. The expansion cone 40 has a longitudinal bore 43 that allows passage of the inner string tool 20 so that the expansion cone 40 surrounds at least a portion of the inner string tool 20. The outer diameter of the inner string tool 20 is smaller than the diameter of the expansion cone bore 43, so that the expansion cone 40 can slide axially relative to the inner string tool 20. In addition, the expansion cone 40 has a top section 45 that tapers radially inward with distance from bottom section 42.

The expandable liner hanger system 10 can include additional features, such, as, for example, locking ridges 46 positioned on the outer surface of the inner casing string 15. In one embodiment, the looking ridges 46 are axially spaced apart projections that protrude radially outward from an outer surface of the inner casing string 15 and circumscribe the inner casing string 15. In certain embodiments, the locking ridges 46 may be made of metal. In addition, the expandable liner hanger system 10 can include seals 48 on the outer surface of the inner casing string 15 shown above and below the ridges 46. Such seals may be elastomeric. Hydraulic force intensifier centralizers 50 and inner casing string centralizers 52 may also be included in the system. Furthermore, a hollow liner wiper plug 54 and a stop ring 62 may be positioned in the inner casing string 15 below the torque limiting sleeve 16. Plug 54 includes frusto-conical ridges circumscribing an annular body. The stop ring 62 can be aluminum or any other suitable material. An opening 56 formed axially through the hollow liner wiper plug 54 (shown, e.g., in FIG. 4) can align with a torque sleeve opening 58 (shown in FIG. 2) and an inner string tool opening 60.

In practice, the expandable liner hanger system 10 locks and seals the interface between an inner and an outer casing string. In an example, these functions are accomplished by carrying out the following method steps. Initially, the inner casing string 15 is lowered into the outer casing string 12, and inner casing string centralizer 52 is positioned within the outer casing string 12 at a predetermined position. In addition, the stop ring 62 and hollow liner wiper plug 54 are inserted into the inner casing string 15, and additional elements such as the locking ridges 46 and the seals 48 can be positioned around the inner casing string 15. Next, torque limiting sleeve 16, the hydraulic force intensifier 18, including the inner string tool 20, and the expansion cone 40 are inserted into the inner/outer casings 15, 12. These elements may be assembled outside the wellbore and inserted together as one assembly. In one embodiment, when fully assembled, the expandable liner hanger system 10 will appear substantially as shown in FIG. 1 and described above.

Figure 4:
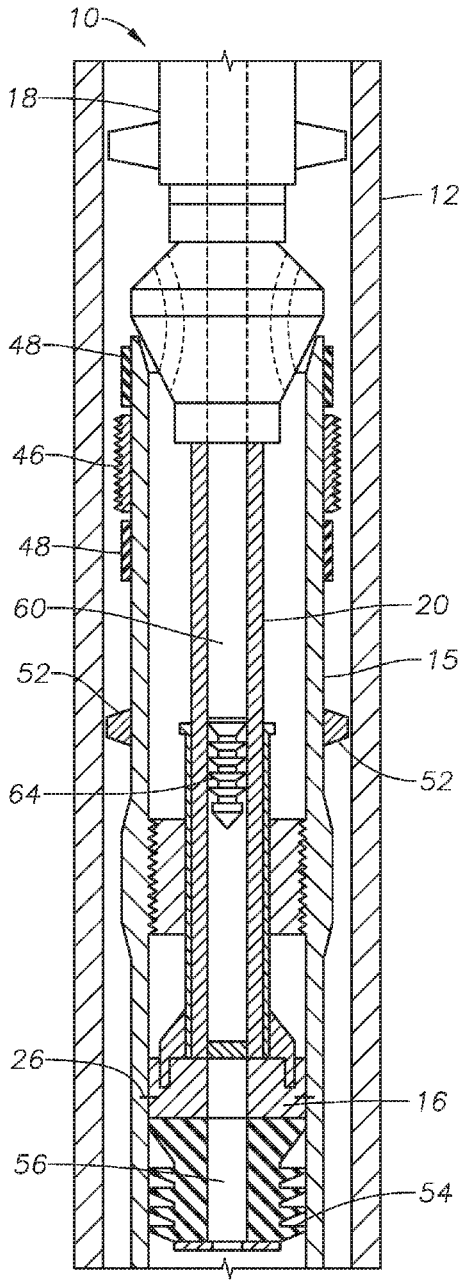
FIG. 4 is a side cross-sectional view of an embodiment of the expandable liner hanger system with a wiper dart in the axial bore of an inner string tool.
Figure 5:
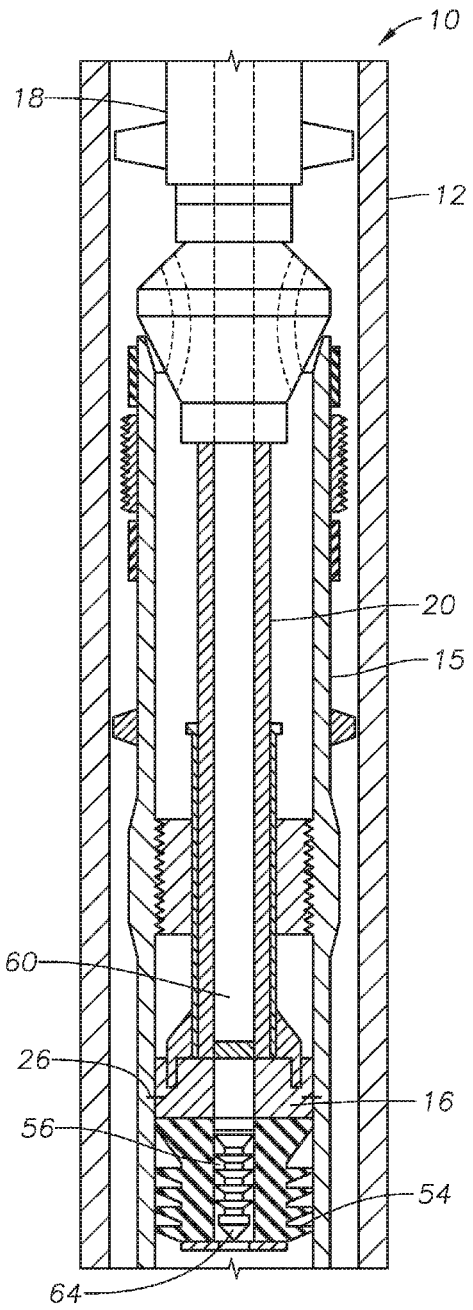
FIG. 5 is a side cross-sectional view of an embodiment of the expandable liner hanger system with a wiper dart in a hollow liner wiper plug.

With the system assembled as shown in FIG. 1, fluids may be circulated through the inner string tool opening 60, the torque sleeve opening 58, and the hollow liner wiper plug opening 56. Fluids that can be circulated include cleaning fluids, followed by a cement slurry. The cement slurry can run through the hole as known in the art to cement the inner casing string in the wellbore. After the cement slurry has been run, and as shown in FIG. 4, a wiper dart 64 can be inserted, such as by dropping the wiper dart 64 and displacing it from the surface by mud or water, into the inner string tool opening 60, the torque sleeve opening 58, and into the hollow liner wiper plug opening 56, as shown in FIG. 5.

Figure 6:
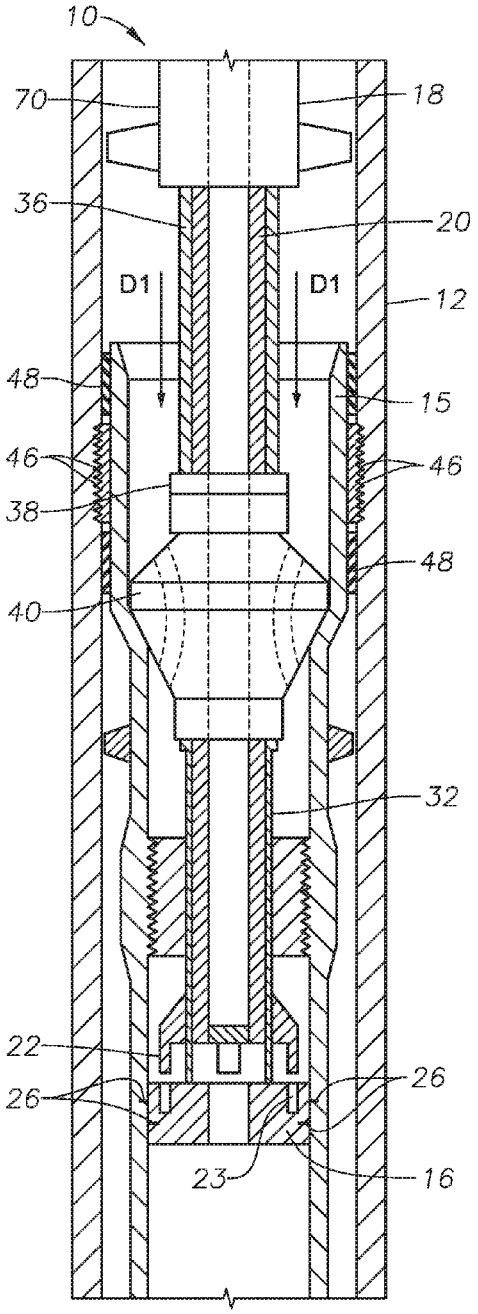
FIG. 6 is a side cross-sectional view of an embodiment of the expandable liner hanger system with an expansion cone inserted into the upper end of the inner casing string.

Next, as best shown in FIG. 6, the hydraulic force intensifier 18 is activated by dropping a ball 86, as described below in reference to FIGS. 15 and 16. Upon activation, the force head 38 of the sliding mandrel 36 moves downward in a direction indicated by arrows D1. The downwardly moving force head 38 contacts the expansion cone 40 and forces it to move downward as well. Alternately, the force head 38 could be attached to the expansion cone 40. Because at least a portion of the expansion cone 40 has a diameter that is greater than the inside diameter of the inner casing string 15, as the expansion cone 40 enters the inner casing string 15 it forces a top portion of the inner casing string 15 to expand radially outward. This radial outward expansion forces the locking ridges 46 radially outward into locked engagement with the inner surface of the outer casing string 12. In some embodiments, the inner surface of the outer casing string 12 can have recesses configured to receive the locking ridges 46. In other embodiments, the locking ridges 46 can be made of a material that is harder than the material of the outer casing string 12, so that the inner surface of the outer casing string 12 plastically deforms around the locking ridges 46 as they expand radially outward. Furthermore, in certain embodiments the locking ridges can be metal. As the upper portion of inner casing string 15 expands radially outward, the seals 48 can also come into contact with the outer casing string 12 to seal the interface between the outer casing string 12 and the inner casing string 15. In addition, the tapered top section 45 of the expansion cone 40 allows for re-expansion of a portion of the inner casing string 15 above the expansion cone 40 if that portion reduces in diameter after the initial expansion due to resilience in the expanded inner casing string 15 or for other reasons.

Also shown in FIG. 6 is the disengagement of the sleeve engaging feet 22 of the inner string tool 20 from the torque looking sleeve 16. As the expansion cone 40 moves downwardly into the upper portion of the inner casing string 15, it contacts the tops of the bars 32 of the inner string tool 20. Because the bars 32 contact the torque locking sleeve 16 at lower ends of the bars 32, the downward movement of the expansion cone 40 forces the break of the shear pins 26. The effect of this continued exertion of force is that the hydraulic force intensifier 18, including the inner string tool 20, moves the bars 32 downwardly, relative to the inner casing string 15, and pushes away the torque locking sleeve 16. This downward movement causes disengagement of the sleeve engaging feet 22 of the inner string tool 20 from the torque locking sleeve 16.

Figure 7:
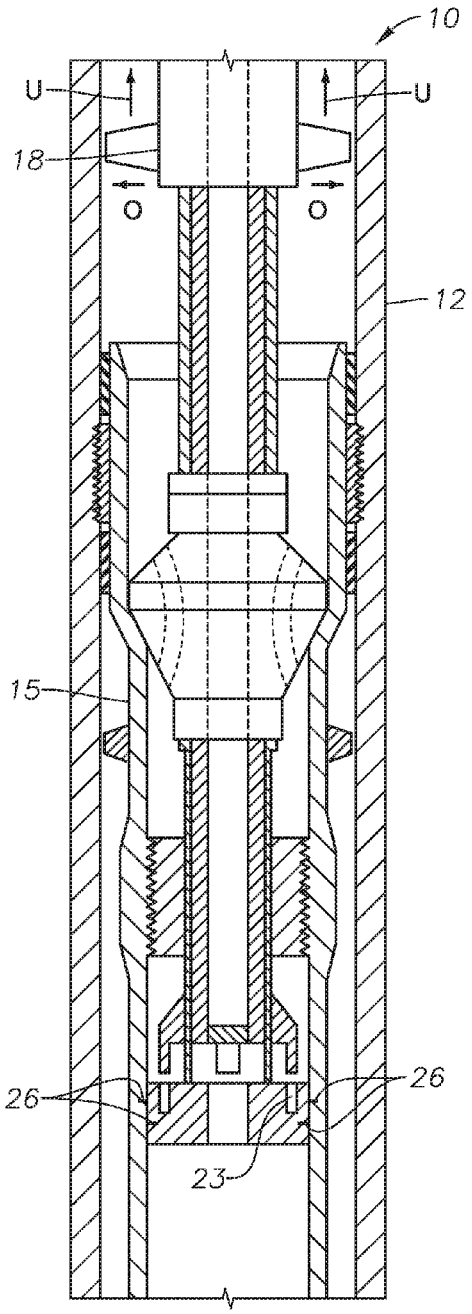
FIG. 7 is a side cross-sectional view of an embodiment of the expandable liner hanger system showing a path of a cleaning fluid.

Referring now to FIG. 7, there is shown the step of removing residual cement slurry (if any) from the portion of the outer casing string 12 above the interface between the inner and outer casing strings 15, 12. This step can be accomplished by introducing cleaning fluid to the wellbore through dump valves 66 (shown, in FIGS. 12, 15, and 16 and described below) in the hydraulic force intensifier 18. The cleaning fluid can move radially outwardly foam the hydraulic force intensifier 18 in a direction O into the outer casing string 12, and then upwardly in a direction U in an annulus between the outer casing string 12 and the hydraulic force intensifier 18, and toward the top of the outer casing string 12. This outward and upward motion of the cleaning fluid carries residual cement slurry and other contaminates away from the expandable liner hanger system 10. In some embodiments, the cleaning fluid may be mud or water.

Figure 8:
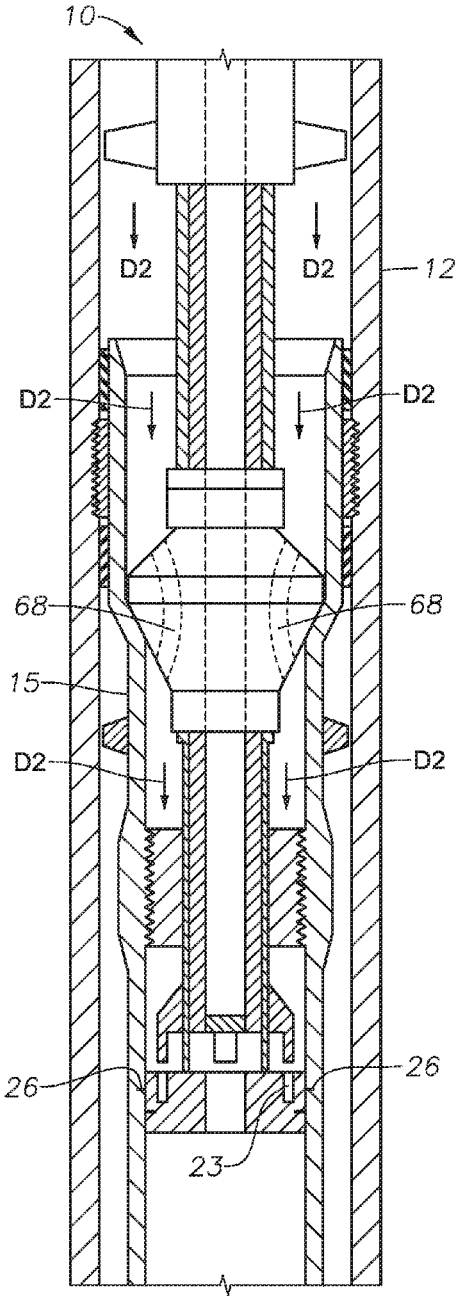
FIG. 8 is a side cross-sectional view of an embodiment of the expandable liner hanger system showing a path of fluid during pressure testing.

FIG. 8 shows the step of pressure testing the interface between the inner and outer casing strings 15, 12 where pressure is increased in the annulus by pumping additional fluid in a downward direction D2. The increased pressure is equalized between portions of the annulus above the expansion cone 40 and portions below the expansion cone 40 by pressure equalization holes 68 shown formed axially through the expansion cone 40. The pressure equalization holes 68 provide fluid communication between portions of the annulus above and below the expansion cone 40. If the interface between the inner and outer casing string 15, 12 is properly locked and sealed, the increased pressure downstream from the interface of the inner and outer casing strings 15, 12 will be contained within the inner casing string 15, and there will be no relative movement between the inner casing string 15 and the outer casing string 12.

Figure 9:
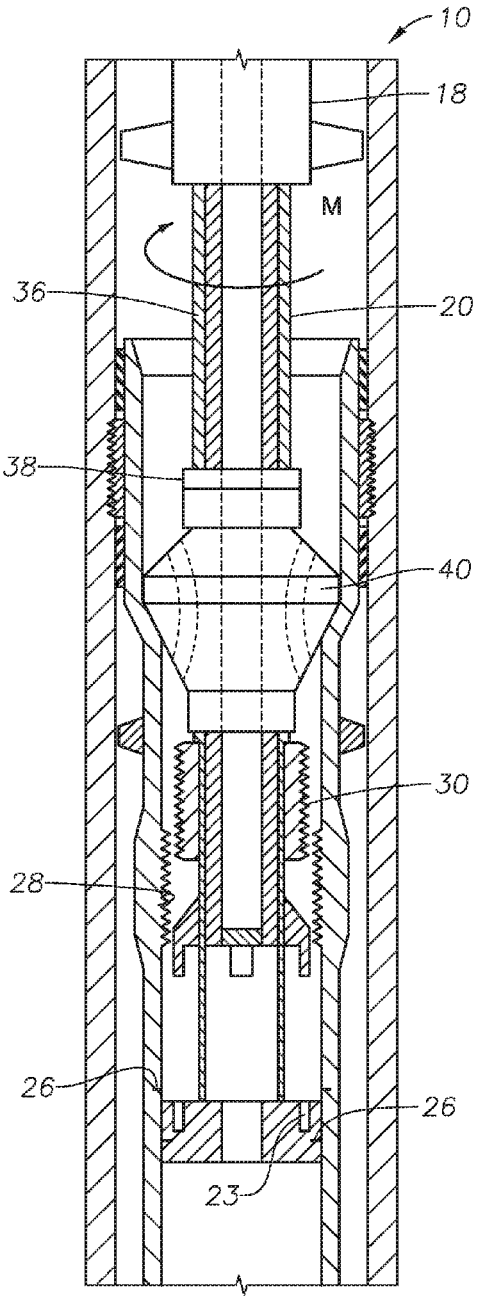
FIG. 9 is a side cross-sectional view of an embodiment of the expandable liner hanger system with the inner string tool substantially disengaged from an inner casing string.
Figure 10:
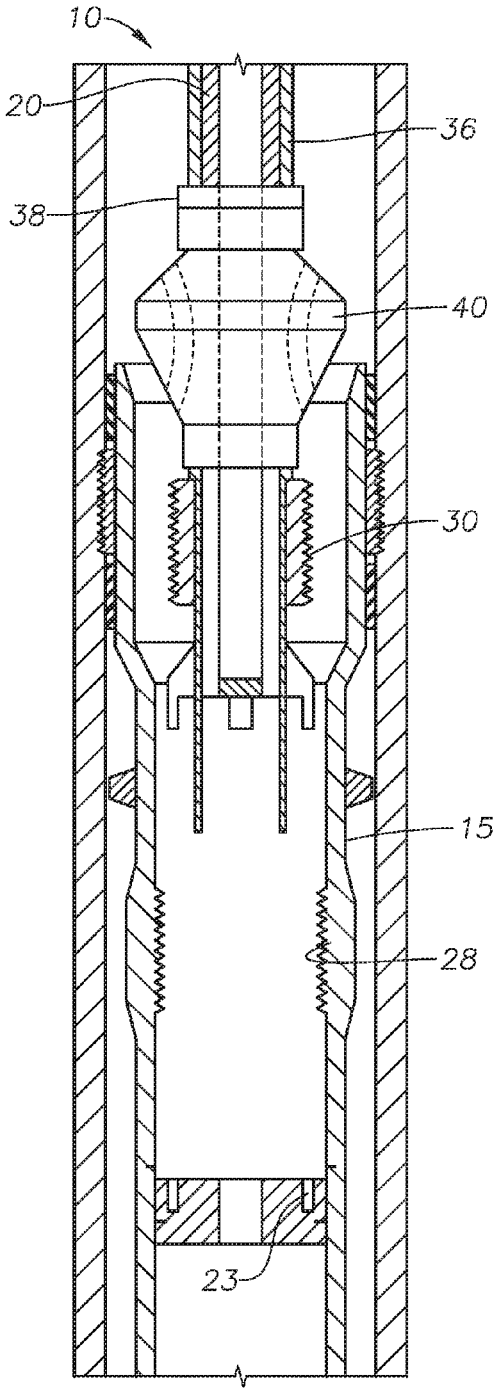
FIG. 10 is a side cross-sectional view of an embodiment of the expandable liner hanger system with the expansion cone and a hydraulic force intensifier being withdrawn from a bore hole.

FIGS. 9 and 10 show the step of removing the hydraulic force intensifier 18 and the expansion cone 40 from the hole. After lowering the pressure in the annulus to acceptable levels, and as shown in FIG. 9, the inner string tool 20 is disengaged from the inner casing string 15. As discussed above, the embodiments of the figures show an inner string tool 20 having locking ridges 30 on an outer surface, which can be a plurality of male threads. These threads engage a locking profile 28 of the inner casing hanger 15, which locking profile can be a plurality of female threads. In one embodiment, to release the inner string tool 20 from the inner casing hanger 15, the hydraulic force intensifier 18 is rotated, as indicated by arrow M. The rotation causes the threads of the inner string tool 20 and the inner casing hanger 15 to disengage. Once the threads are disengaged, the hydraulic force intensifier 18, including the inner string tool 20, and the expansion cone 40, can be lifted upward (as shown in FIG. 10), and out of the hole. These elements can be lifted out of the hole as the work string (typically drillpipe) is pulled out of the hole.

Figure 11:
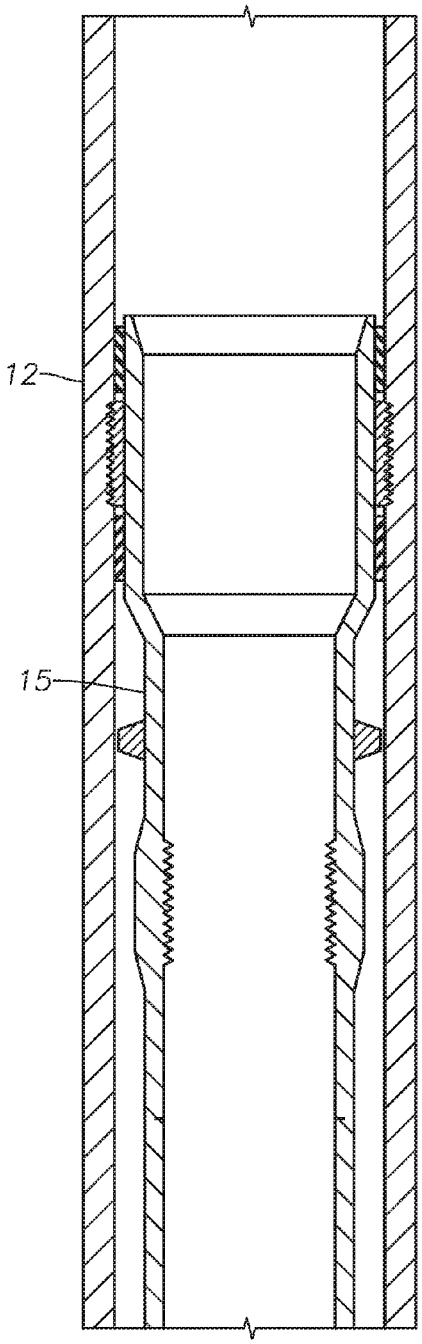
FIG. 11 a side cross-sectional view of an embodiment of the expandable liner hanger system after removal of the torque locking sleeve by clean-out operation of the cemented liner.

As shown in FIG. 11, with the hydraulic force intensifier 18 and the expansion cone 40 removed from the hole, the remaining component (e.g., the torque locking sleeve 16) may be removed from the hole, leaving the inner casing string 15 in sealed, locked engagement with the outer casing string 12. At this point, the joint between the inner and outer casing strings 15, 12 can again be tested. For example, pressure in the annulus may be raised about 2000 psi for about 15 minutes to verify the pressure seal between the casing strings.

The above-described expandable liner system is advantageous because it allows rotation of the liner while running the hole, it provides bigger liner hanger running clearance for cementing the casing string, and it provides a liner hanger having both elastomer (seals 48) and metal-to-metal (locking profile 46 and outer casing string 12) seals. In addition, the system provides a simple, cost effective, and robust design, which allows maximum running clearance and full circulation rate to facilitate liner running and cementing operation. The system can also be deployed for reaming the liner to setting depth of liner drilling applications, or can be deployed for floating and pushing/rotating the liner into an extended reach wellbore.

Figure 12:
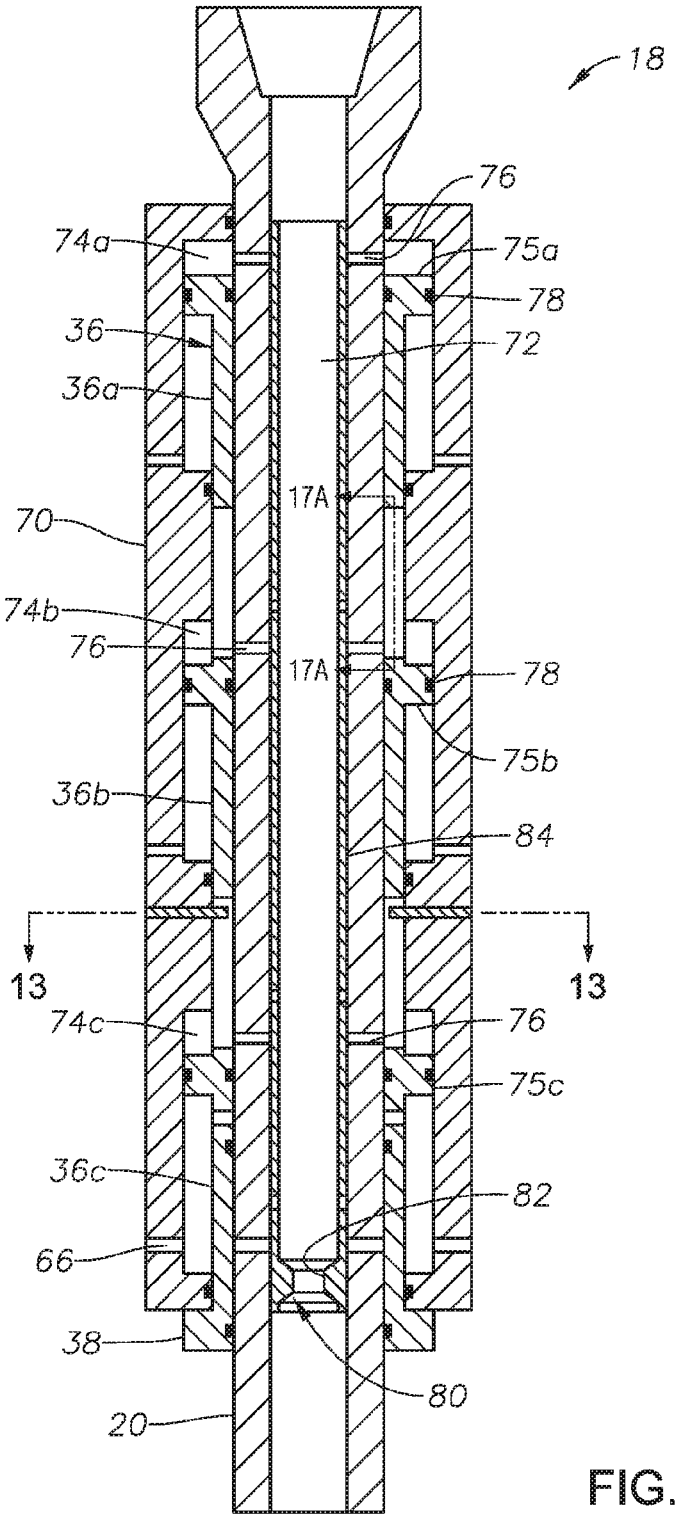
FIG. 12 is a side cross-sectional view of an embodiment of a hydraulic force intensifier.

FIG. 12 shows a side cross-sectional view of the hydraulic force intensifier 18, including the inner string tool 20, the sliding mandrel 36, and an outer housing 70 that surrounds the sliding mandrel 36 and the inner string tool 20. The inner string tool 20 has an axial bore 72. The sliding mandrel 36 is divided into mandrel portions 36*a*, 36*b*, 36*c*, shown stacked axially on the inner string tool 20. The mandrel 36 substantially surrounds the inner string tool 20, and is axially slideable relative to the inner string tool 20. As shown, the mandrel portions 36*a*, 36*b*, 36*c* are partially separated from the outer housing 70 by axially spaced apart gaps 74*a*, 74*b*, 74*c*. Each gap 74*a*, 74*b*, 74*c* defines an annular cylinder circumscribing the mandrel 36. Pistons 75*a*, 75*b*, 75*c* are shown depending radially outward from respective upper ends of the mandrel portions 36*a*, 36*b*, 36*c* and into the gaps 74*a*, 74*b*, 74*c*. The gaps 74*a*, 74*b*, 74*c* are in fluid communication with the axial bore 72 of the inner string tool 20 via fluid ports 76 formed radially through inner string tool 20. In addition, mandrel seals 78 are located on the outer periphery of each piston 75*a*, 75*b*, 75*c* to define a pressure barrier between the piston 75*a*, 75*b*, 75*c*, and outer housing 70. The mandrel seals 78 can be O-ring seals. Within the axial bore 72 of the inner string tool 20 is a ball seat 80 which includes protrusions 82 extending into the axial bore 72 from the inner surfaces of the inner string tool 20. In addition, there may optionally be an inner movable sleeve 84 within the axial bore 72. The inner movable sleeve 84 is initially at an up position so that it is configured to isolate the axial bore 72 from the hydraulic chambers or gaps 74*a*, 74*b*, and 74*c*, thereby preventing premature deployment of the sliding mandrel 36. The protrusions 82 can be attached to, or formed integrally with, the inner moveable sleeve 84.

Figure 13:
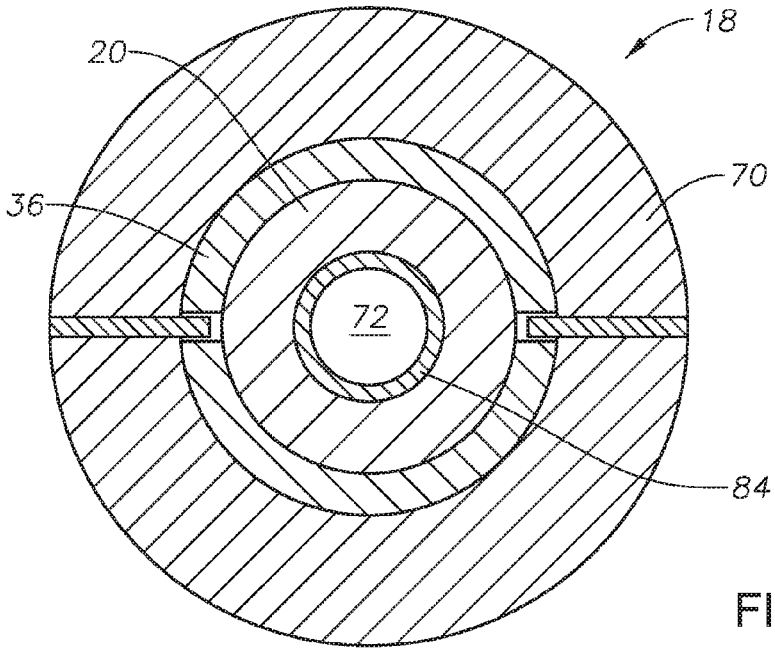
FIG. 13 is a transverse cross-sectional view taken along the line 13-13 of FIG. 12.

FIG. 13 is a cross-sectional view of the hydraulic force intensifier 18 taken along line 13-13 of FIG. 12. As can be seen, the inner string tool 20 is surrounded by the sliding mandrel 36, which is in turn surrounded by the outer housing 70. In the embodiment shown, shear pins 86 may extend radially through the outer housing 70 and into the sliding mandrel 36 to constrain movement of the sliding mandrel 36 relative to the outer housing 70 in a radial direction.

Figure 14:
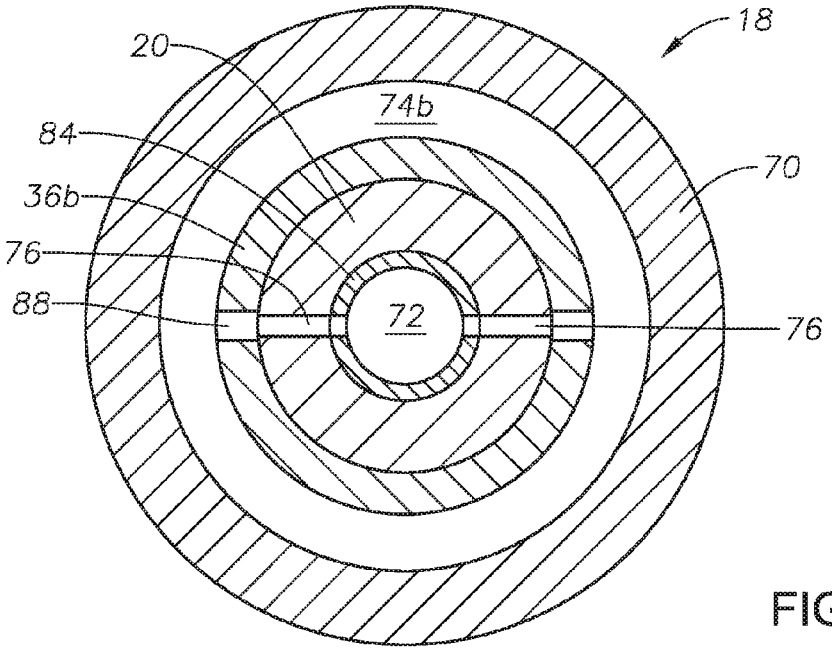
FIG. 14 is a transverse cross-sectional view taken along the line 14-14 of FIG. 15.
Figure 15:
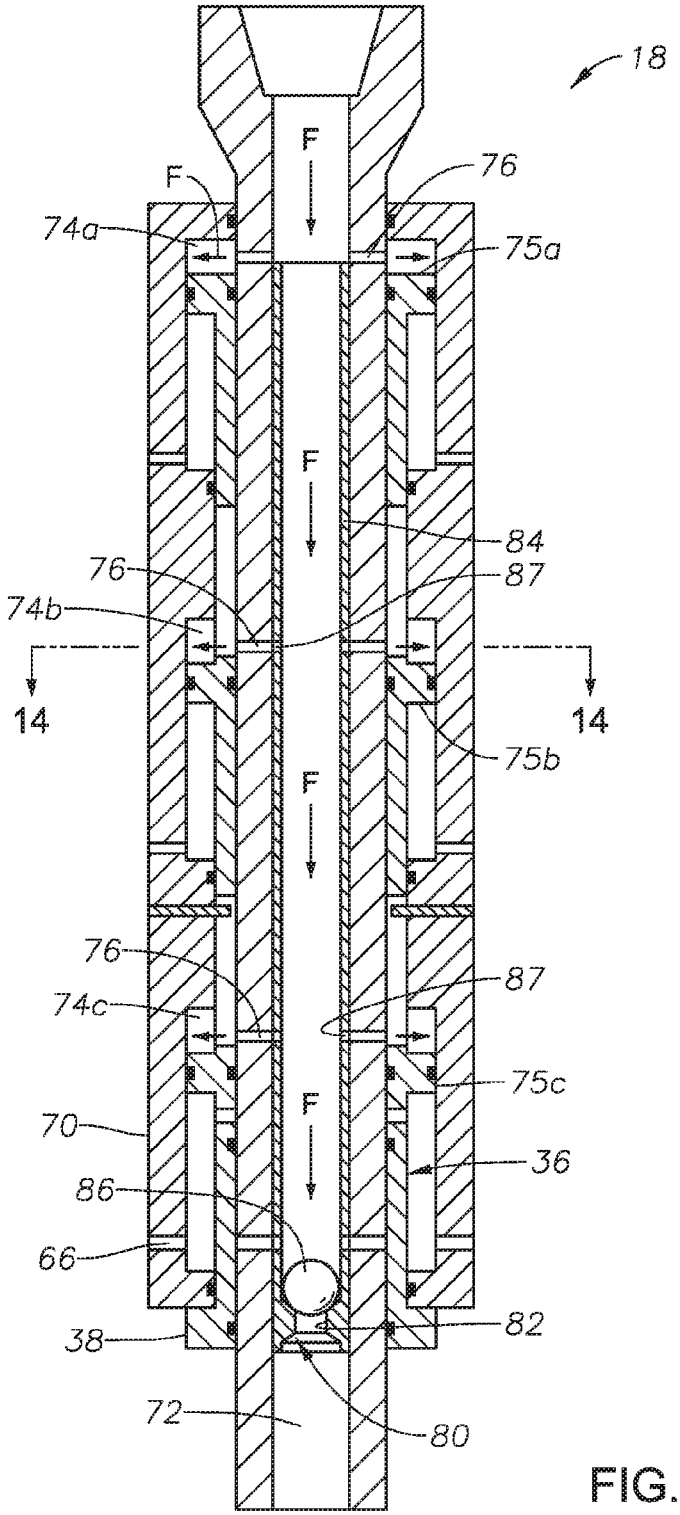
FIG. 15 is a side cross-sectional view of an embodiment of the hydraulic force intensifier with a ball and ball seat, and with a sliding mandrel in the up position.

FIG. 14 similarly shows a cross-sectional view of the hydraulic force intensifier 18 taken along line 14-14 of FIG. 15. In this view, the inner string tool 20 is seen surrounded by the sliding mandrel portion 36*b*, which is in turn surrounded by the outer housing 70. Between the sliding mandrel 36 and the outer housing 70 are the gaps 74*a*, 74*b*, 74*c*, which are in fluid communication with the axial bore 72 of the inner string tool 20 via fluid ports 76.

Figure 16:
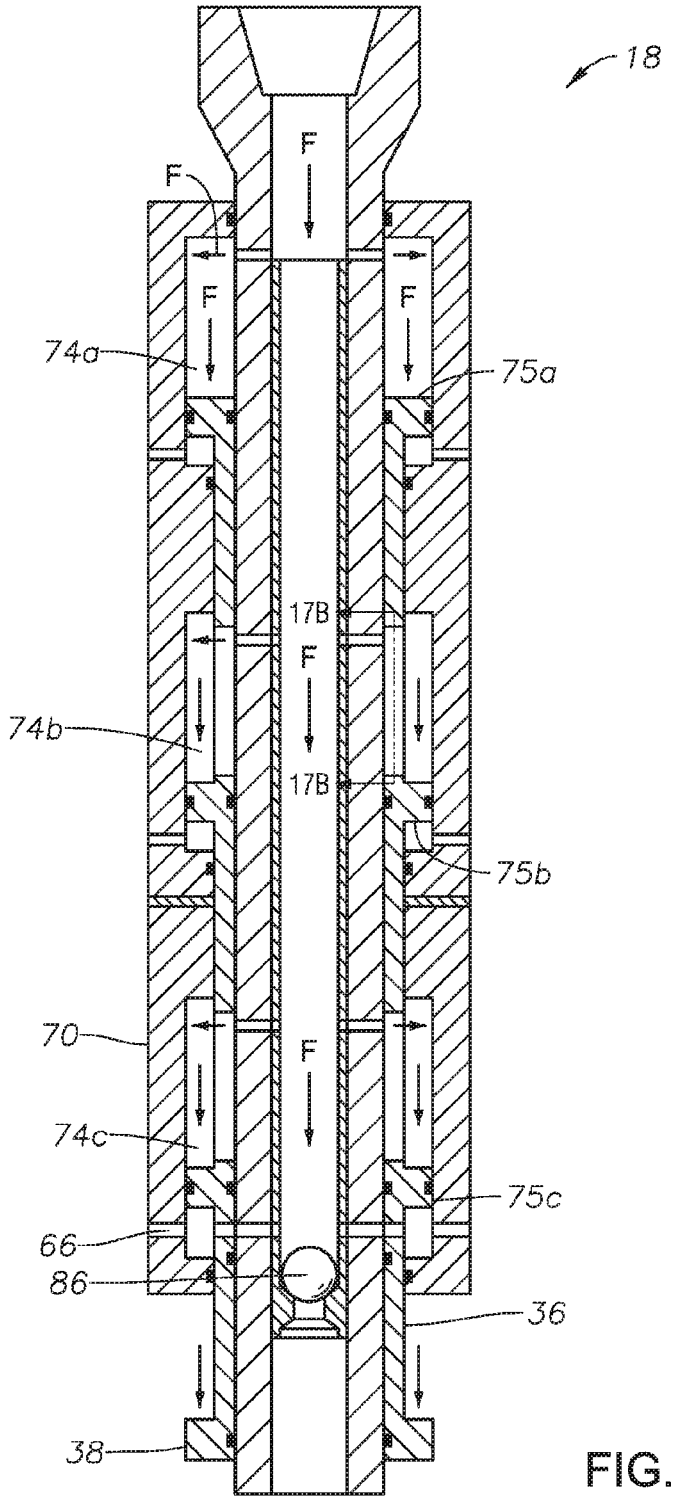
FIG. 16 is a side cross-sectional view of an embodiment of the hydraulic force intensifier with a ball and ball seat, and with the sliding mandrel in the down position.

The sliding mandrel 36 of the hydraulic force intensifier 18 is moveable to an up position, in which the force head 38 is raised until it is adjacent to the outer housing 70 (see, e.g., FIGS. 5 and 15), and to a down position, in which the force head 38 is lowered to a position remote from the outer housing 70 (see, e.g., FIGS. 6 and 16). Initially, cement slurry can be pumped down the axial bore 72 of the inner string tool 20, as described above. This may occur while the sliding mandrel 36 is in the up position and the inner moveable sleeve 84 is in the up position, thereby isolating the axial bore 72 from the hydraulic chamber or gaps 74*a*, 74*b*, 74*c* of the sliding mandrel 36. Thereafter, and as shown in FIG. 15, a ball 86 is inserted into the axial bore 72. The ball 86 has a diameter that is greater than the space between the protrusions 82 that make up the ball seat 80. Thus, when the ball 86 reaches the ball seat 80, it is stopped from moving further down the hole by the ball seat 80. In an example, the ball 86 and ball seat 80 are configured so that ball 86 seals against ball seat 80, thereby prohibiting fluid from moving down the axial bore 72 around the ball 86. When the ball 86 contacts the ball seat 80, it can also push the inner movable sleeve 84 into a down position so that apertures 87 in the inner movable sleeve 84 align with the fluid ports 76 of the inner string tool 20, thereby allowing fluid communication between the axial bore 72 of the inner string tool 20 and the gaps 74*a*, 74*b*, 74*c*.

FIG. 15 shows the sliding mandrel 36 in its up position, with the force head 38 positioned adjacent to the outer housing 70, and with the ball 86 seated in ball seat 80. To initiate movement of the sliding mandrel 36 toward its down position, fluid is introduced to an upper end of the axial bore 72 of the inner string tool 20. From there, the fluid is pumped downward through the axial bore 72, through the apertures 87 and fluid ports 76, and into the portion of the gaps 74*a*, 74*b*, 74*c* above each piston 75*a*, 75*b*, 75*c*, as indicated by arrows F. As more fluid is introduced into the axial bore 72, the pressure within the portions of gaps 74*a*, 74*b*, 74*c* increases, thereby pushing the sliding mandrel 36 downward until the sliding mandrel 36 reaches its down position (shown in FIG. 16).

FIG. 16 shows the sliding mandrel in its down position, with the force head 38 positioned remote from the outer housing 70. As can be seen, when the sliding mandrel 36 reaches the down position, dump valve 66 is opened from the axial bore 72 to the outside of the outer housing 70. Dump valve 66 allows excess fluid to be discharged to the annulus outside the hydraulic force intensifier 18 as the pistons 75*a*, 75*b*, 75*c* move downward within the gaps 74*a*, 74*b*, 74*c*. Thus configured, the required actuation pressure is low compared with known tools.

Figure 17A:
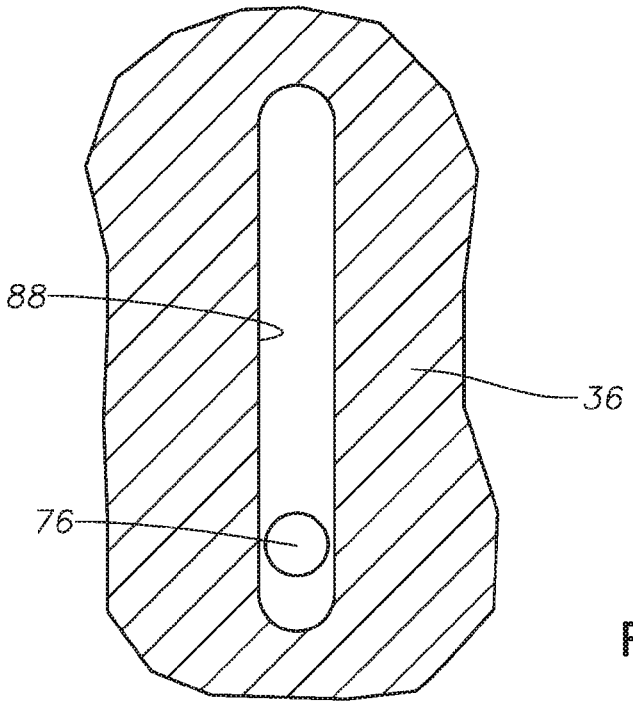
FIG. 17A is a cross-sectional view of a portion of the sliding mandrel and fluid port taken along line 17A-17A of FIG. 15.
Figure 17B:
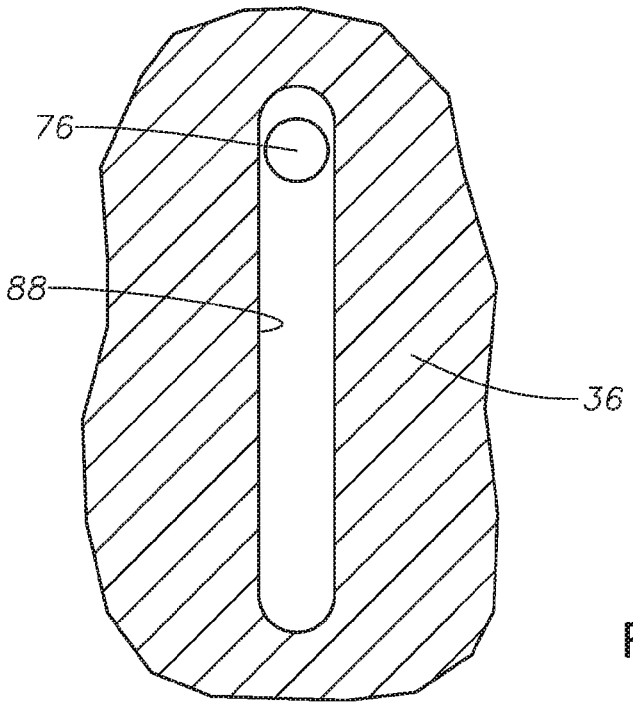
FIG. 17B is a cross-sectional view of a portion of the sliding mandrel and fluid port taken along line 17B-17B of FIG. 16.

FIGS. 17A and 17B show cross-sectional views of part of the sliding mandrel 36 as taken along lines 17A-17A and 17B-17B of FIGS. 15 and 16, respectively. FIGS. 17A and 17B show the longitudinal slots 88 that permits fluid communication between gaps 74*a*, 74*b*, 74*c* and the axial bore 72 throughout the transition of the sliding mandrel 36 from its up to its down position. For example, FIG. 17A shows the mandrel 36 in its up position, with the fluid port 76 registered with the bottom of the longitudinal slot 88. As the sliding mandrel 36 moves downward, the portion of the fluid ports 76 that passes through the inner string tool 20 remains stationary. Thus, as shown in FIG. 17B, when the sliding mandrel is in its down position, the fluid port 76 registers with the top of the longitudinal slot 88.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An expandable liner hanger system for forging a pressure seal and hanging of a liner weight against an outer casing string in a wellbore, the expandable liner hanger system comprising:

the outer casing string;

an inner casing string positioned within the outer casing string and having an inner diameter;

elastomeric seals and metal-to-metal locking ridges that circumscribe the inner casing string selectively form a sealing interface between the inner casing string and the outer casing string;

an elongated inner string tool selectively insertable into the inner casing string and having a torque locking sleeve that removably couples with the inner casing string;

an expansion cone slidable along the inner string tool and having a diameter greater than the inner diameter of the inner casing string so that when the expansion cone is urged into the inner casing string, the larger diameter cone deforms the inner casing string radially outward into engagement with the outer casing string, wherein the expansion cone has a pressure equalization hole that provides fluid communication between a bottom portion and a top portion of the expansion cone; and a hydraulic force intensifier having an end coupled with the expansion cone, so that when fluid is introduced into the intensifier, the intensifier pushes the expansion cone into the inner casing string.

2. The expandable liner hanger system of claim 1, wherein the inner casing string has locking ridges on an outer surface thereof, the locking ridges arranged so that when the portion of the inner casing string expands into engagement with the outer casing string, the locking ridges fixedly engage the outer casing string.

3. The expandable liner hanger system of claim 1, further comprising a seal surrounding the inner casing string and arranged to seal an interface between the inner and outer casing strings when the portion of the inner casing string is expanded into engagement with the outer casing string.

4. The expandable liner hanger system of claim 1, further comprising:

a slide bar having a first end and a second end, wherein the slide bar is attached to the inner string tool and is axially slideable relative thereto, the slide bar arranged so that an upper end of the slide bar contacts the expansion cone when the expansion cone is inserted into the inner casing string, and upon contact with the expansion cone, a lower end of the slide bar contacts the torque locking sleeve and pushes the torque locking sleeve out of engagement with the inner string tool.

5. The expandable liner hanger system of claim 1, wherein the expansion cone equalizes pressure between an area below the expansion cone and an area above the expansion cone when the expansion cone is pushed into the inner casing string.

6. The expandable liner hanger system of claim 1, further comprising a shear pin that engages the torque locking sleeve and the inner casing hanger and that limits axial movement therebetween.

7. The expandable liner hanger system of claim 1, wherein the hydraulic force intensifier further comprises:

a sliding mandrel having first and second ends and surrounding the inner string tool, the sliding mandrel hydraulically driven between a first position and a second position; and a force head attached to the second end of the sliding mandrel that contacts the expansion cone and pushes it into the inner casing string when the sliding mandrel moves from the first position to the second position.

8. The expandable liner hanger system of claim 7, wherein the hydraulic force intensifier further comprises:

a gap between at least a portion of the sliding mandrel and the inner string tool, the gap fluidly connected to an inner surface of the inner string tool by a fluid port; and an inner movable sleeve positioned inside the inner string tool and having an aperture, the inner movable sleeve having an open position and a closed position;

wherein when in an open position the aperture is aligned with the fluid port so that there is fluid communication between the gap and the inside of the inner string tool; and when in a closed position the aperture is not aligned with the fluid port so that the gap is isolated from the inside of the inner string tool.

9. The expandable liner hanger system of claim 7, wherein the inner string tool of the hydraulic force intensifier has teeth that engage the inner casing string to prevent axial movement of the inner string tool relative to the inner casing string.

10. The expandable liner hanger system of claim 1, wherein the expansion cone has tapered upper and lower surfaces with a minimum diameters less than the inner diameter of the inner casing string.

* * * * *